US006260213B1

(12) United States Patent
Eom et al.

(10) Patent No.: US 6,260,213 B1
(45) Date of Patent: Jul. 17, 2001

(54) SHIELD CONNECTOR FOR HELMET

(75) Inventors: Ju Sung Eom; Jeong Hwan Park, both of Yong In (KR)

(73) Assignee: Hong Jin Crown Croporation, Kyungki-Do (KR)

( * ) Notice: Subject to any disclaimer, the term of this patent is extended or adjusted under 35 U.S.C. 154(b) by 0 days.

(21) Appl. No.: 09/439,680

(22) Filed: Nov. 15, 1999

Related U.S. Application Data

(63) Continuation-in-part of application No. 09/255,105, filed on Feb. 22, 1999, now abandoned, and a continuation-in-part of application No. 08/929,386, filed on Sep. 15, 1997, now abandoned.

(51) Int. Cl.[7] ..... A42B 1/08
(52) U.S. Cl. ..... 2/424
(58) Field of Search ..... 2/9, 424, 425, 2/6.5

(56) References Cited

U.S. PATENT DOCUMENTS

| | | | | |
|---|---|---|---|---|
| D. 376,674 | | 12/1996 | Kamata . | |
| 3,491,372 | * | 1/1970 | Aileo | 2/9 |
| 4,748,696 | * | 6/1988 | Fohl | 2/424 |
| 4,866,792 | * | 9/1989 | Arai | 2/424 |
| 5,062,162 | * | 11/1991 | Kamata | 2/424 |
| 5,333,329 | * | 8/1994 | Hong | 2/424 |
| 5,461,731 | * | 10/1995 | Shida | 2/424 |

* cited by examiner

*Primary Examiner*—Rodney Lindsey

(57) ABSTRACT

A shield connecting system for a helmet has components mounted on the right and left sides of the helmet, and components that are provided on the face shield. The components that are mounted on each side of the helmet include a fixation mechanism that has a rotation member, a first resilient plate, and a second resilient plate which is installed under the first resilient plate. The fixation mechanism has a protrusion and a guide for guiding the rotation of the rotation member. The rotation member has at an adjacent portion thereof an aperture. An insertion guide portion to correspond to the aperture is formed in a front portion of the aperture. The first resilient plate has at a rear portion thereof a protrusion. The shield to be coupled with the fixation mechanism has, for an assembly of the assembly with the helmet body, at both inner end surfaces thereof a connection member to be inserted to the rotation member, a protruded guide, and a rack-shaped control member. The protruded guide and rack-shaped control member control the degree of rotation of the shield by the first and second resilient plates. In one embodiment of the invention, the user locks the shield into place by moving a locker arm that is mounted on the helmet from an open position to a closed position, thereby rotating a member that locks the shield onto the helmet. In another embodiment, a member associated with the face shield moves the locker arm to a closed position as the shield is lowered over the opening in the helmet, to provide automatic locking.

16 Claims, 14 Drawing Sheets

SHIELD CONNECTOR FOR HELMET

RELATED APPLICATIONS

This is a continuation-in-part of U.S. patent application Ser. Nos. 09/255,105 and 08/929,386, which were filed Feb. 22, 1999 and Sep. 15, 1997, respectively, and which are both incorporated by reference herein and are now both abandoned. This application also claims priority from Korean Patent Application No. 22098, which was filed on Nov. 13, 1998.

BACKGROUND OF THE INVENTION

1. Field of the Invention

The present invention relates to a helmet for protecting the rider's head, and more particularly, to a mechanism for mounting the face shield to the helmet.

2. Description of the Conventional Art

Riders of motor vehicles such as motorcycles and snowmobiles must wear protective helmets. Such protective helmets have an opening in the front of the helmet and a transparent face shield that is mounted to raise and lower over the opening. When the shield is lowered over the helmet opening, it protects the rider from debris, bugs and wind.

A conventional shield connector is structured as follows. Rotation members are formed at both side surfaces of the helmet, both ends of the shield are coupled to the helmet, an additional cover is provided thereon, and bolts are provided for fixation. At a lower inner portion of the shield, a rotation control member having upraised teeth is formed. The shield is assembled to the helmet in such a way that the rotation control member is caught by a catching member formed on the helmet. The shield can be opened or closed being assembled to the helmet.

One example of a prior art face shield mounting system is illustrated in U.S. Pat. No. 5,333,329, which issued on Aug. 2, 1994 and is hereby incorporated by reference.

The face shield system of U.S. Pat. No. 5,333,329 was an improvement over the prior art at that time and has proven to be a very good system. However, experience has shown that further improvements can be made. In the design of the '329 patent, one end of the shield is assembled into one of the rotation members formed at both surfaces of the helmet while the other end of the shield is assembled into the other the rotation members formed at both surfaces of the helmet, and at such a state, bolts are fixed to the rotation members, to thereby install the shield. In addition, the shield is assembled to be movable up and down. However, up and down movement of the shield depends on the fixation condition of fixation mechanism. Further, if the fixation is not rigid, the shield may be detached from the helmet.

SUMMARY OF THE INVENTION

It is an object of the present invention to provide an improved system for connecting a face shield to a helmet. It is also an object of the invention to provide an improved helmet face shield.

In one embodiment of the present invention, an improved shield connector system for a helmet and face shield allows easy and reliable opening and closing of the shield over the front face of the helmet. It also allows convenient assembly of the mechanism on the helmet and convenient and reliable attachment of the shield to the helmet.

According to one embodiment of the present invention, a helmet mounting system includes a helmet and a face shield.

A shield-receiving unit is mounted on the helmet. The shield-receiving unit has a locker arm and a shield-receiving channel. The face shield is adapted to be mounted to the shield-receiving unit. The face shield has at least one protrusion adapted to engage into the shield-receiving channel. The mounting system has a locked configuration in which the shield protrusion is engaged in the shield-receiving channel and the locker arm is in a locked position, and an unlocked configuration in which the locker arm is moved to an unlocked position relative to the locked position.

According to another embodiment of the present invention, a shield connector has at both end surfaces of the helmet a fixation mechanism consisting of an insertion and rotation member and a locker. The shield can be easily, quickly, and firmly assembled to the helmet body just by inserting a connection member of the shield to the fixation mechanism, and the shield can be minimally opened.

In a further embodiment of the invention, a system for removably securing a face shield to a helmet includes a base plate mounted on said helmet, the base plate having a ratchet teeth-engaging tooth and a secondary tooth engagement member. A locking ring is mounted on the base plate, the locking ring having a locking handle and a locking protrusion. The system includes a shield retention member having a shield retention slot and at least one shield retention tab. The shield retention member is rotatably mounted on said helmet. A face shield is provided having a winged circular protrusion and an armed engagement member extending from the circular protrusion, and a ratchet teeth member having ratchet teeth. The shield is mounted onto the helmet such that the winged circular protrusion is inserted in the shield retention slot and is retained in the shield retention slot by the shield retention tab, and the ratchet teeth are engaged with the ratchet teeth engaging indentation. The mounting system has a locked configuration in which the locking handle has been rotated into a locked position and in which the locking protrusion is engaged with the locking arm of the shield, and an unlocked configuration in which the locking handle has been rotated into an unlocked position and in which the locking protrusion is disengaged from the locking arm.

The embodiment may have various additional features. A bias spring may be engaged with the locking handle to bias the system into the locked or unlocked configurations. The ratchet teeth and protrusions may be integrally molded with the shield. The shield retention slot may be defined by resilient walls that expand and/or contract as the shield is mounted onto the helmet. For example, there may be one or more protrusions extending partially across the retention slot. If a circular protrusion is provided on the shield and is inserted into the slot, the slot walls can expand as the protrusion first enters the slot, then contract such that the protrusions extending partially across the retention slot retain the circular protrusion in the slot.

The face shield may have a handle protrusion, the handle protrusion engaging the locking handle, the protrusion moving the locking handle as the shield is raised and lowered on the helmet. The handle protrusion on the shield may comprise the ratchet teeth member.

In accordance with another embodiment, a system for removably securing a face shield to a helmet may include a shield retention unit mounted on the helmet. The unit may have at least one tooth extending therefrom, a locking ring having a locking handle and a locking protrusion, and a shield retention slot. The system includes a face shield having a shield protrusion, an armed engagement member and ratchet teeth. The shield may be mounted onto the helmet such that the shield protrusion is inserted in the shield retention slot, and the ratchet teeth are engaged with said at least one tooth. The mounting system has a locked configuration in which the locking handle has been rotated into a locked position and in which the locking protrusion is engaged with the armed engagement member of the shield, and an unlocked configuration in which the locking handle has been rotated into an unlocked position and in which the locking protrusion is disengaged from the armed engagement member.

In accordance with another aspect of the invention, a helmet mounting system has a helmet and a shield receiving unit mounted on said helmet, said shield receiving unit having a locker arm and a shield-receiving aperture. The system also has a face shield adapted to be mounted to the shield receiving unit, the face shield having at least one protrusion adapted to engage into the shield-receiving aperture, the mounting system having a locked configuration in which the shield protrusion is engaged in the shield-receiving aperture and the locker arm is in a locked position, and an unlocked configuration in which the locker arm is moved to an unlocked position relative to the locked position.

Another aspect of the invention concerns the shield alone. A shield according to the present invention comprises a mounting protrusion and an armed engagement member extending from the mounting protrusion, and a ratchet teeth member having ratchet teeth. The shield may be any of the many types of shields typically used on motorcycle and snowmobile helmets, such as standard clear shields, shields having a reflective coating, or heated electric shields that prevent the shield from fogging over in cold weather.

According to another aspect of the present invention, the mounting system is adapted to permit the user to open the face shield to a minimal-open position, in which the face shield is raised just a small distance from the fully closed position and held in position until the user disengages the shield from the minimal-open position.

The present invention will become more fully understood from the detailed description given hereinafter and the accompanying drawings, which are given by way of illustration only, and do not limit the present invention.

DETAILED DESCRIPTION OF A PREFERRED EMBODIMENT

Figure 1:
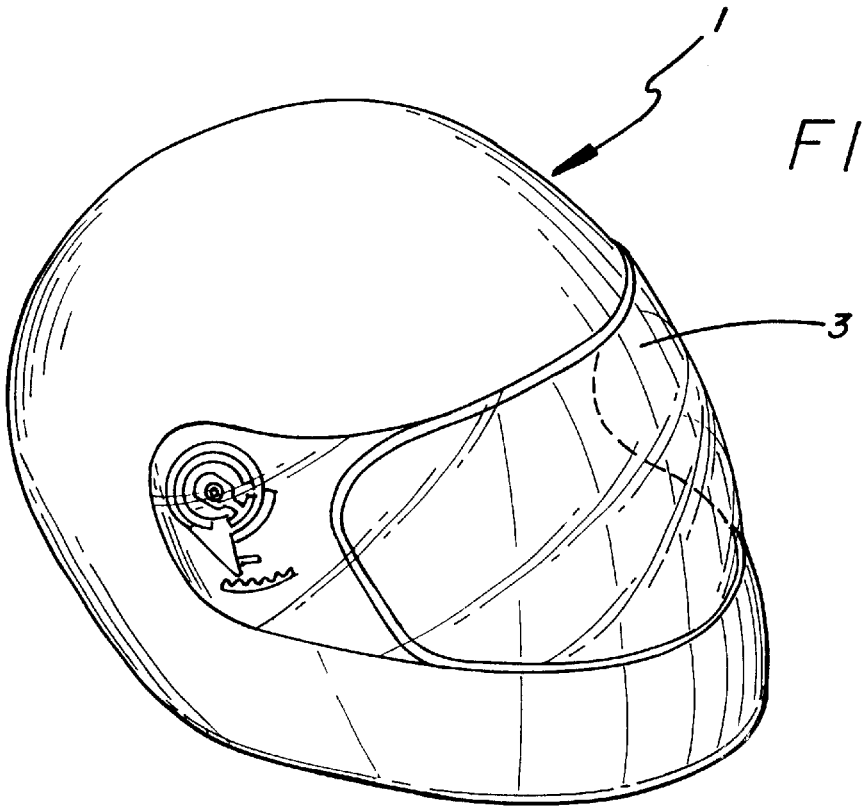
FIG. 1 is a perspective view showing a face shield attached to a helmet, with the face shield lowered over the helmet.
Figure 2:
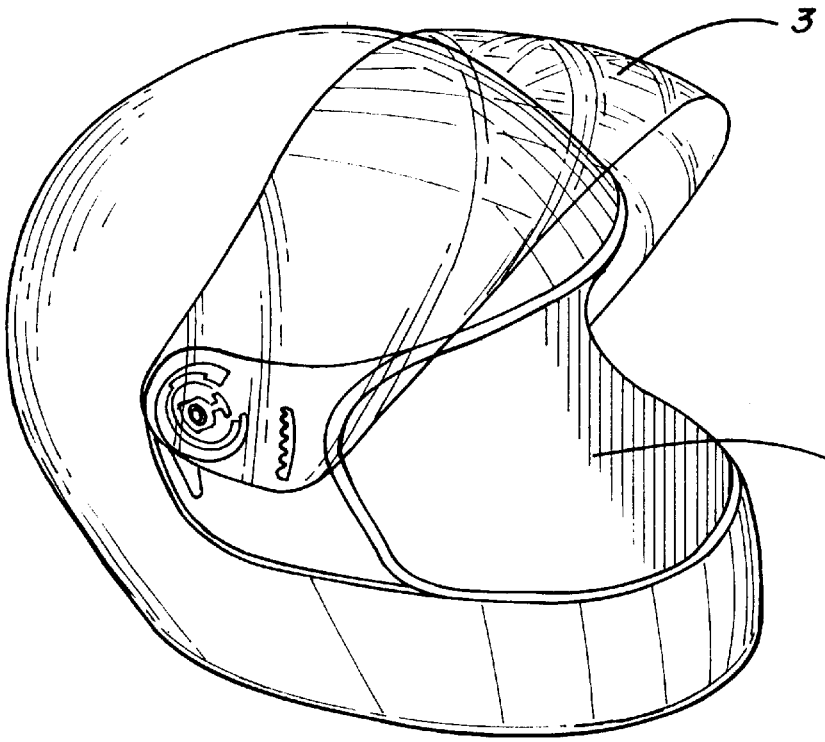
FIG. 2 illustrates the helmet and face shield combination of FIG. 1, with the face shield rotated up from the helmet opening.
Figure 3:
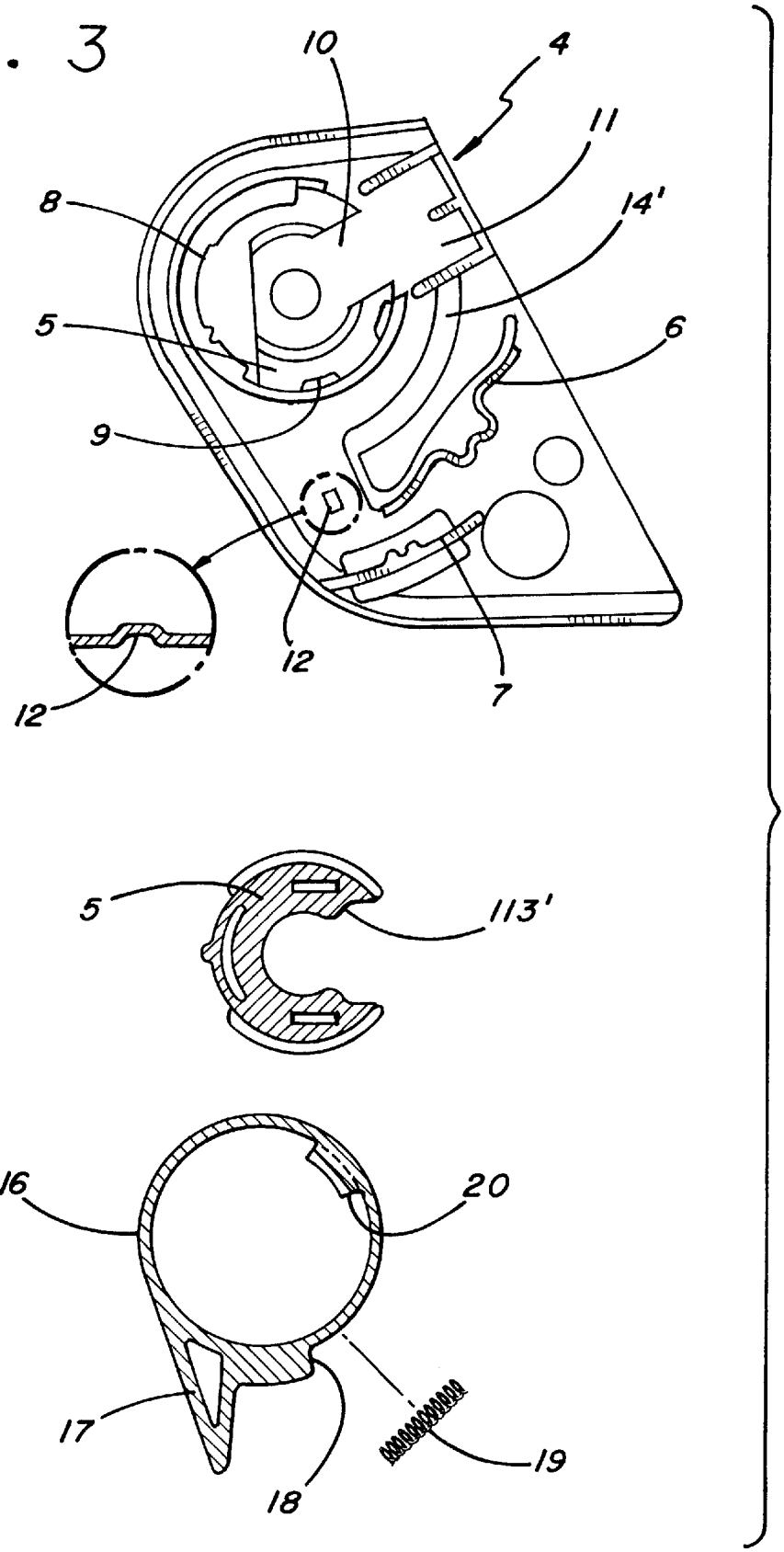
FIG. 3 is an exploded sectional view showing parts of one embodiment of the present invention.
Figure 4:
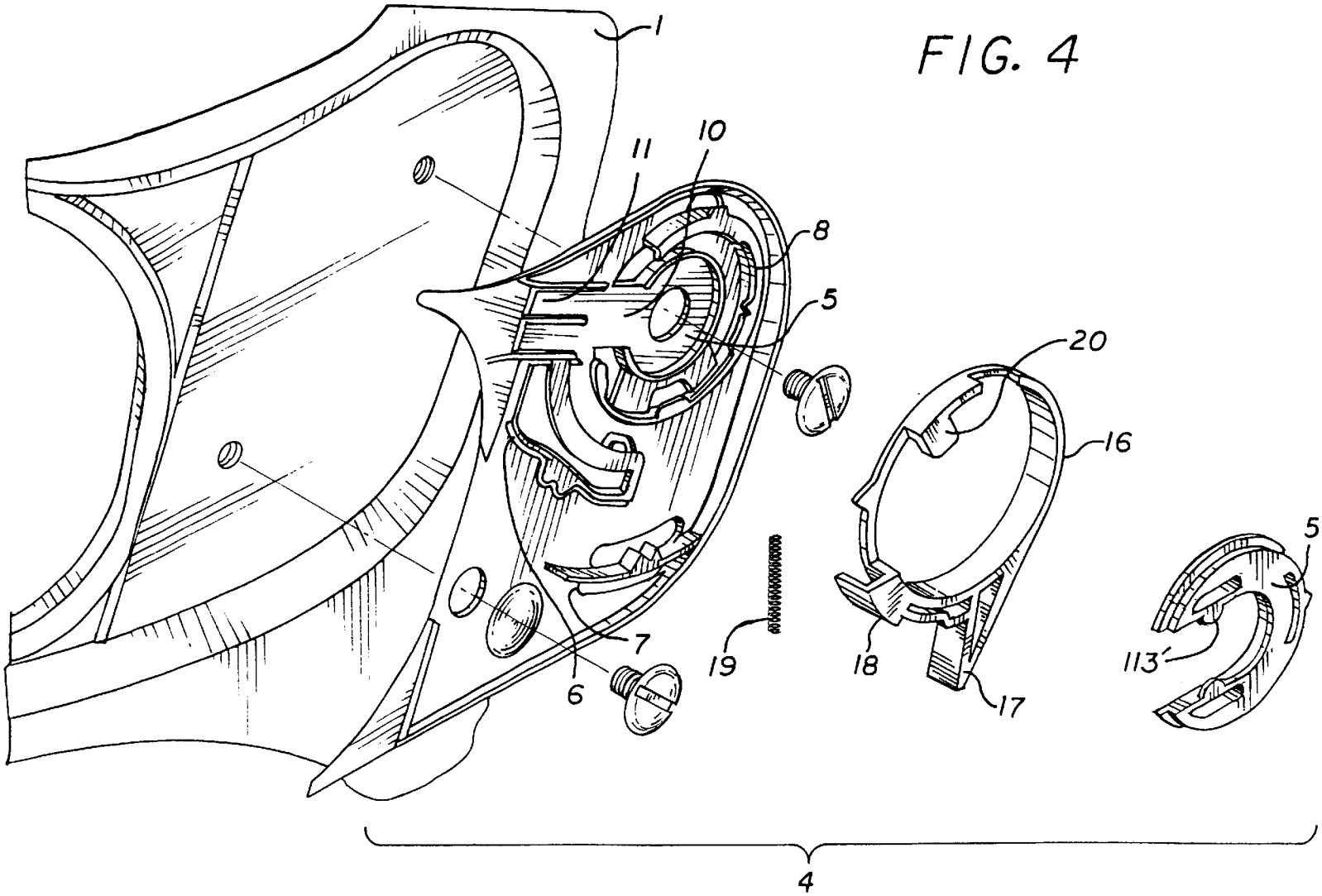
FIG. 4 is an exploded view in perspective showing parts of the embodiment of FIG. 3.

As illustrated in FIGS. 1 and 2 illustrate a first embodiment of the present invention, in which a shield 3 is installed to open and close a front opening 2 of helmet body 1 as shield 3 moves up and down. Both side surfaces of helmet body 1 are provided with a body 1 as shield 3 moves up and down. Referring to FIGS. 3 and 4, both side surfaces of helmet body 1 are provided with a fixation mechanism 4 that includes a rotation member 5, a first resilient plate 6, and a second resilient plate 7 which is installed under first resilient plate 6. A protrusion 9 and a guide 8 for guiding the rotation of rotation member 5 are formed along the outer periphery of rotation member 5.

Figure 5:
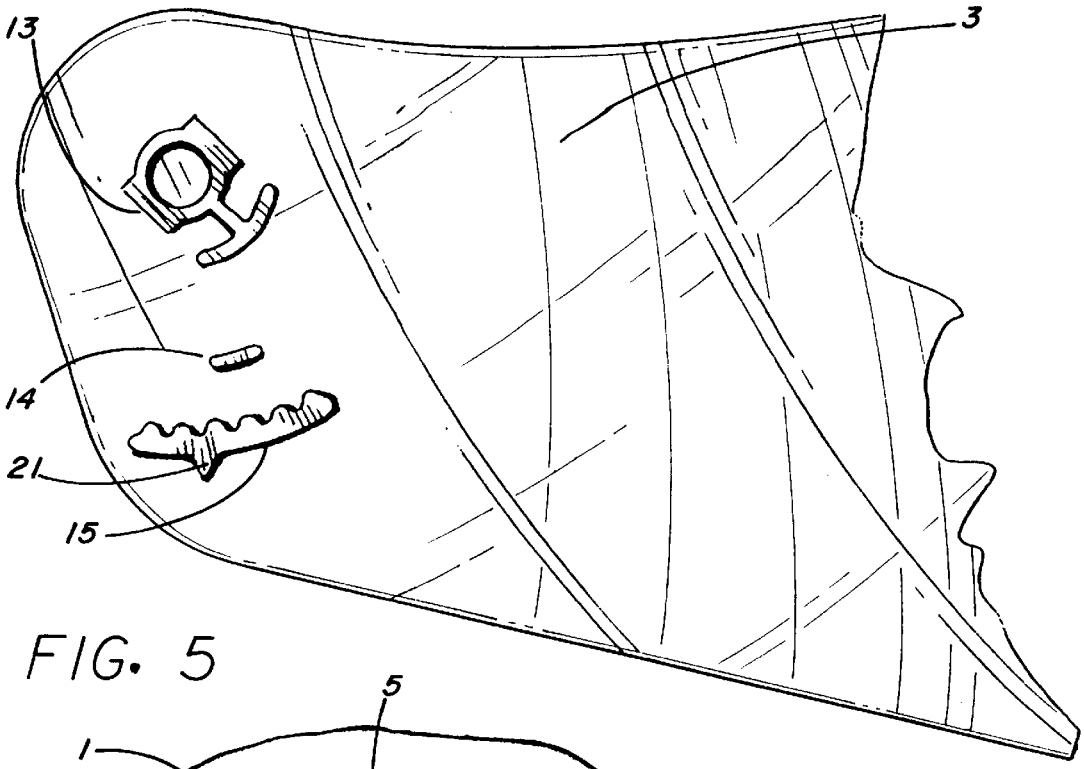
FIG. 5 is an interior view of an end portion of the helmet face shield of the embodiment of FIG. 3.
Figure 7:
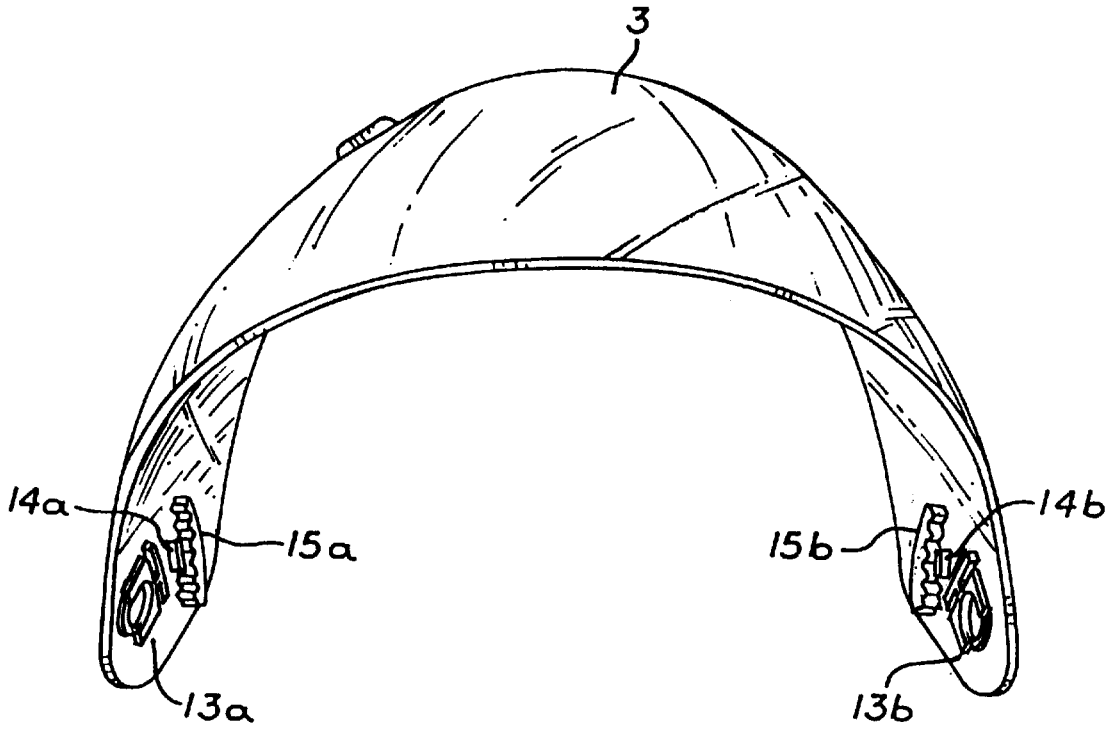
FIG. 7 is a bottom perspective view of a face shield according to the embodiment of FIG. 3.
Figure 8:
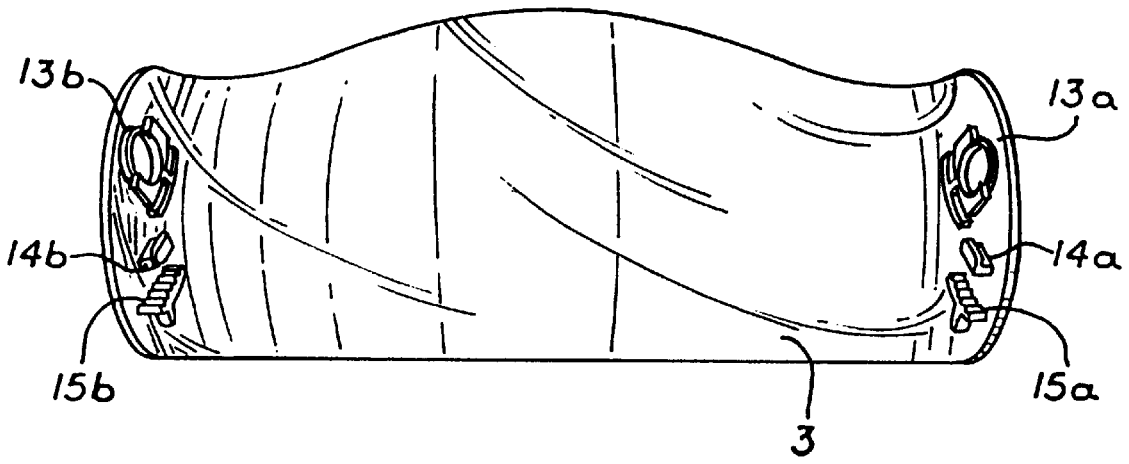
FIG. 8 is a rear perspective view of a face shield according to the embodiment of FIG. 3.

An insertion-guiding portion 11 corresponding to an aperture 10 is formed in a front portion of aperture 10, and a protrusion 12 is formed in a rear portion of first resilient plate 6. A connection member 13 (FIG. 5) to be inserted into rotation member 5 (FIG. 6) is formed at both inner side surfaces of shield 3 which are to be fixed by fixation mechanism 4. The connection member 13 is shown in greater detail in FIGS. 7 and 8. Components 13, 14 and 15 are typically integrally molded a part of the shield. Alternatively, they can take the form of a molded component that is secured to the shield.

Below connection member 13, there is a protruded guide 11, a rack-shaped control member 15 which controls the degree of up and down movement of shield by first and second resilient plates 6 and 7, and a minimum opening control protrusion 21.

Figure 6:
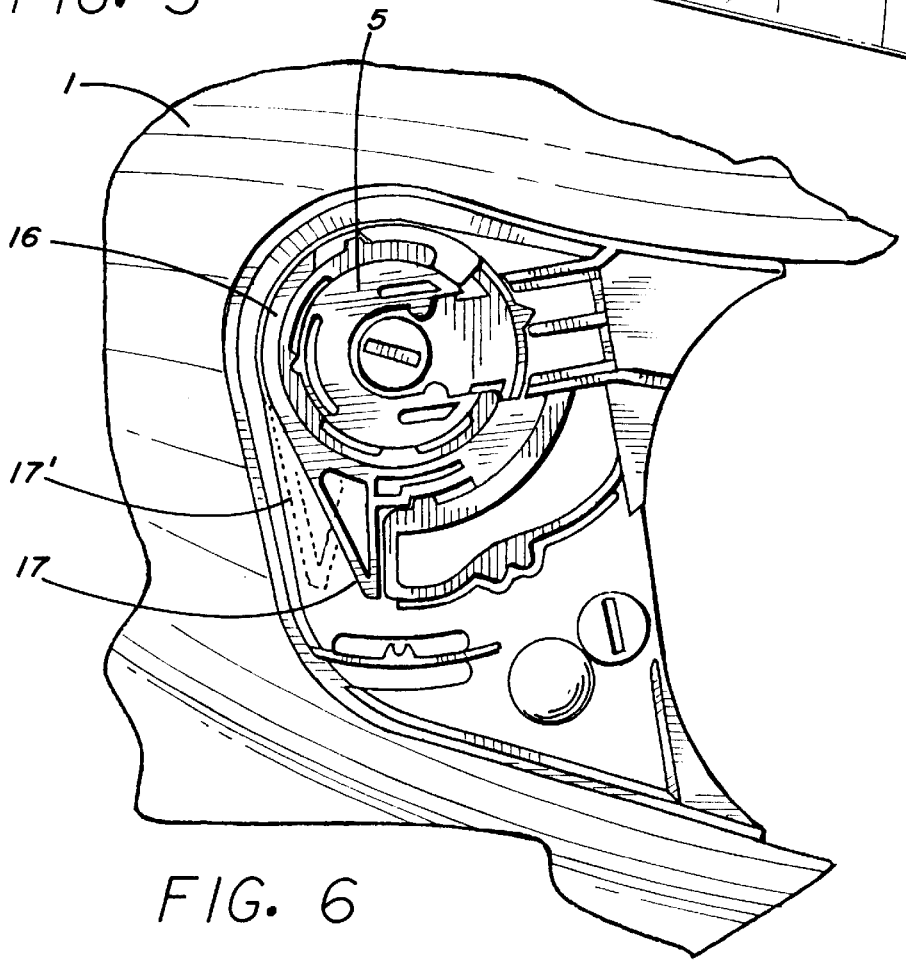
FIG. 6 is a detail view of the portion of the mounting mechanism that is attached to one side of the helmet in the embodiment of FIG. 3.
Figure 9:
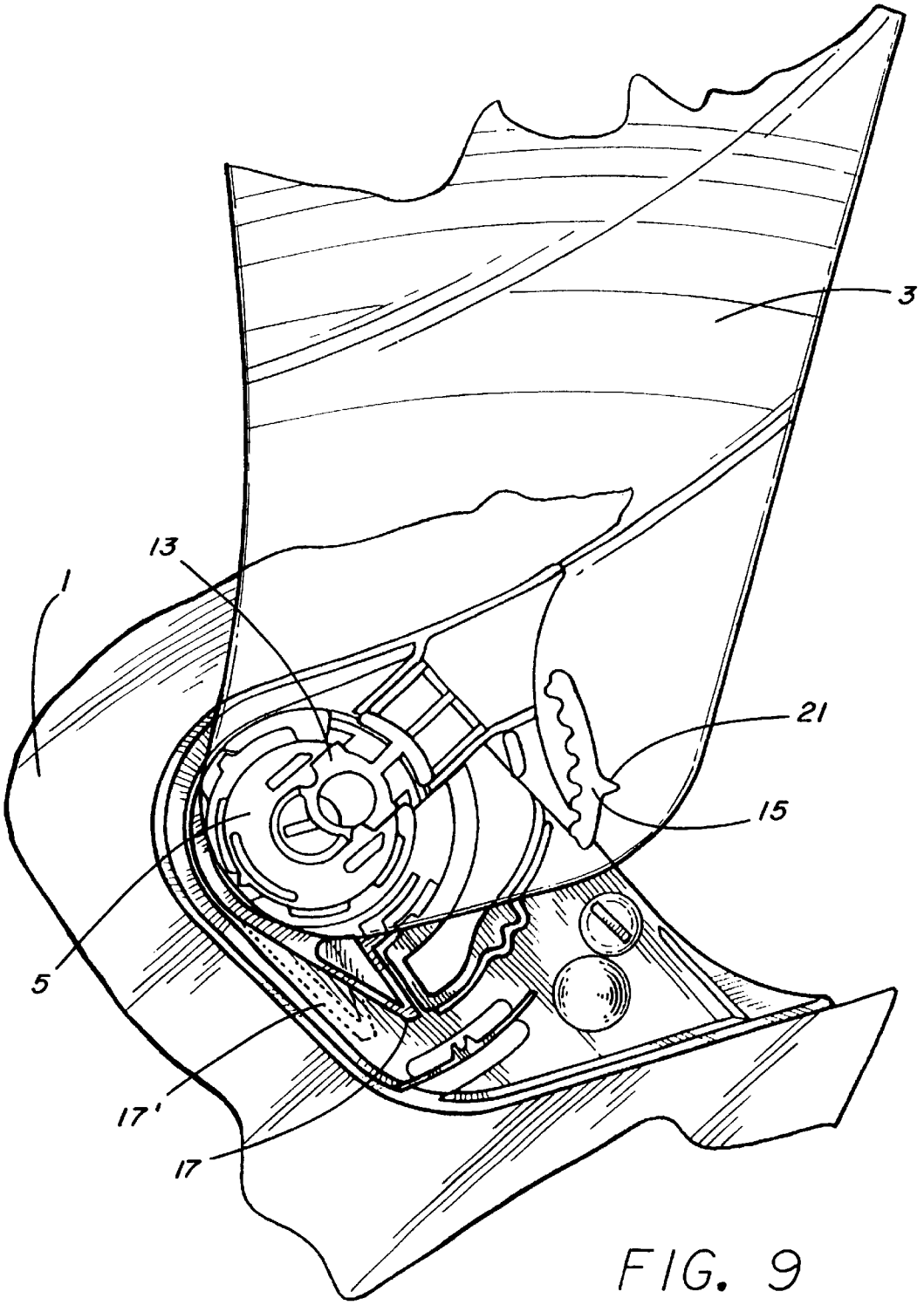
FIG. 9 is a detail view of a shield being mounted and partially engaged into the mounting mechanism.
Figure 10:
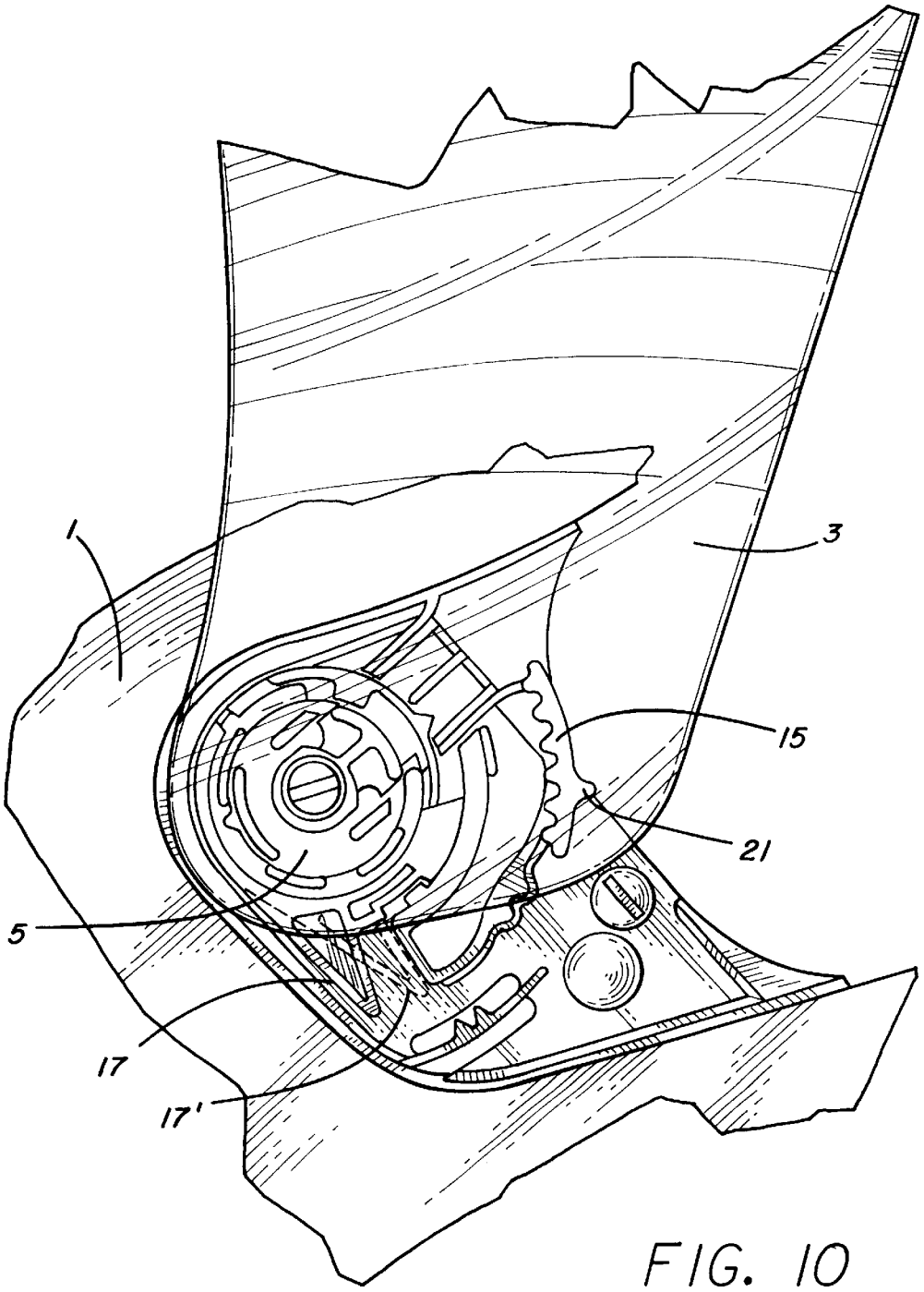
FIG. 10 is a detail view showing the shield fully mounted within the mounting mechanism, and a locking handle shown in both solid and phantom lines to illustrate unlocked and locked configurations, respectively.

A locker 16 having a handle 17 and a locking protrusion 20 is installed to be rotatable along the outer periphery of guide 8. FIGS. 6 and 9 show that the locker handle rotates between an unlocked position in which the locker handle is shown in phantom line, and a locked position in which the locker handle is shown in solid line. FIG. 10 illustrates the shield inserted into the helmet-mounted mechanism, but with the mechanism not yet locked. That is, locking handle 17 is in the unlocked position. A phantom line shows the locking handle 17' moved to the locked position, which serves to secure the face shield within the mechanism until the handle is moved to the unlocked position.

Figure 11:
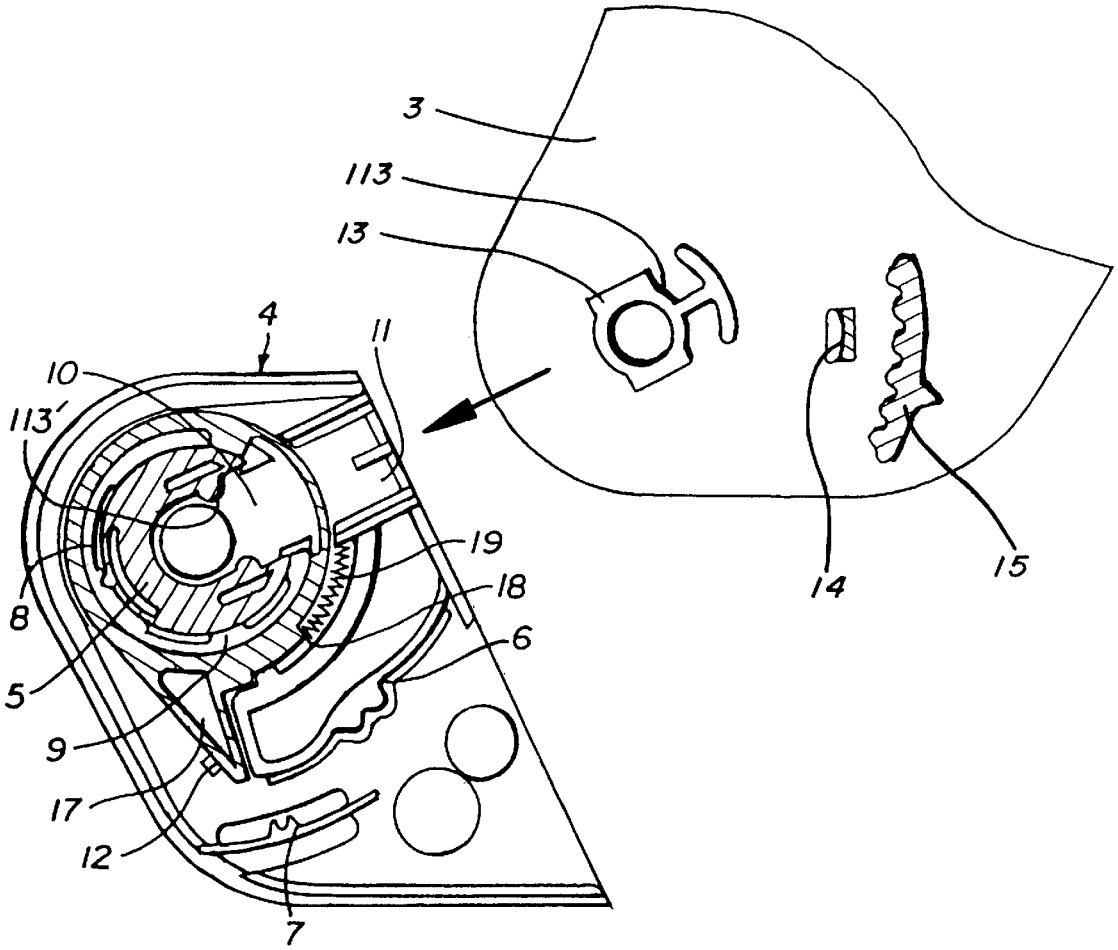
FIG. 11 is a sectional view showing the mounting mechanism of the embodiment of FIG. 3 of the present invention, with a bias spring biasing the locking mechanism into the locked configuration.
Figure 12:
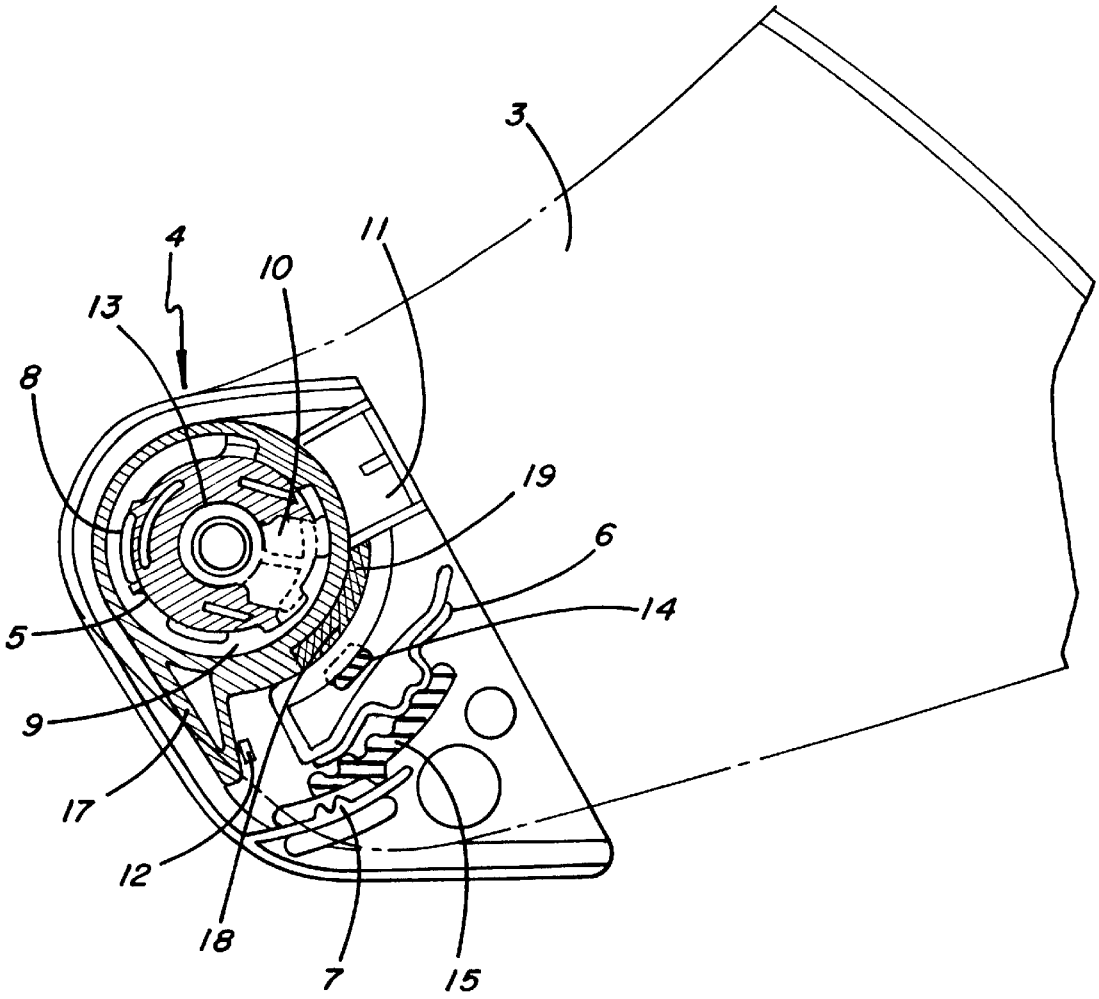
FIG. 12 is another sectional view showing the components of FIG. 10 as the shield is rotated upwardly into an open configuration.

FIGS. 11 and 12 show a spring 19 that biases locker 16 into the locked position. The spring 19 is installed between an indentation 18 of locker 16 and insertion guiding portion 11.

Figure 13:
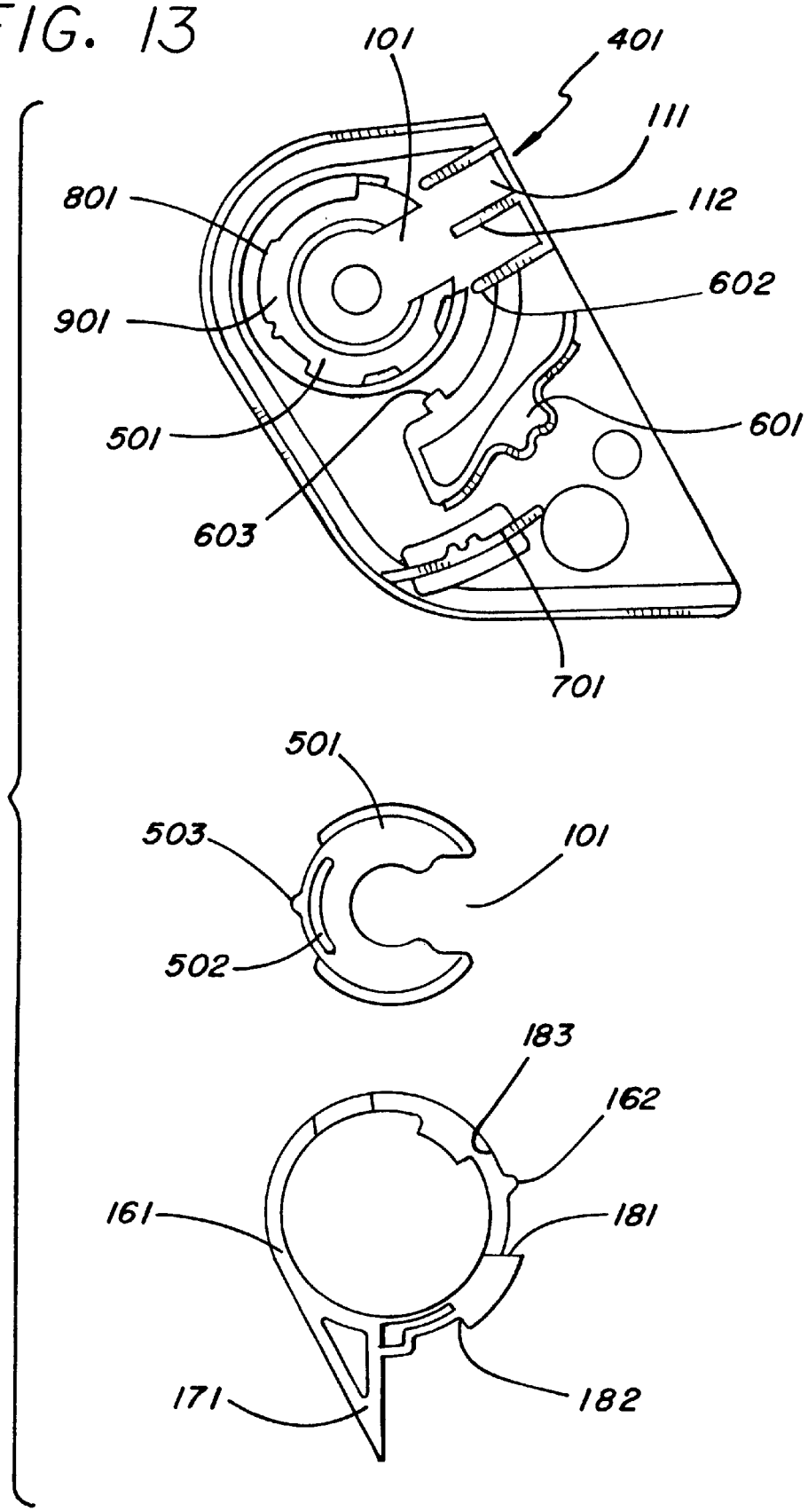
FIG. 13 is an exploded section view showing the main parts of embodiment 2 of the present invention.

Turning now to a second embodiment of the present invention, a shield 3 is installed to open and close a front opening 2 of helmet body 1 as shield 3 moves up and down. As FIG. 13 illustrates, at both side surfaces of helmet body 1, a rotation member 501 which has at the outer periphery thereof a protrusion 503 which operates resiliently by a resilient portion 502, and a fixation mechanism 401 having a first resilient plate 601 with indentations 602 and 603 and a second resilient plate 701 which is provided under first resilient plate 601 are installed. A guide 801 and a protrusion 901 for guiding the rotation of rotation member 501 are formed.

An insertion-guiding portion 111 corresponding to an aperture 101 is formed in a front portion of aperture 101, and a plate 112 is formed at the middle portion of insertion guiding portion 111.

Figure 14:
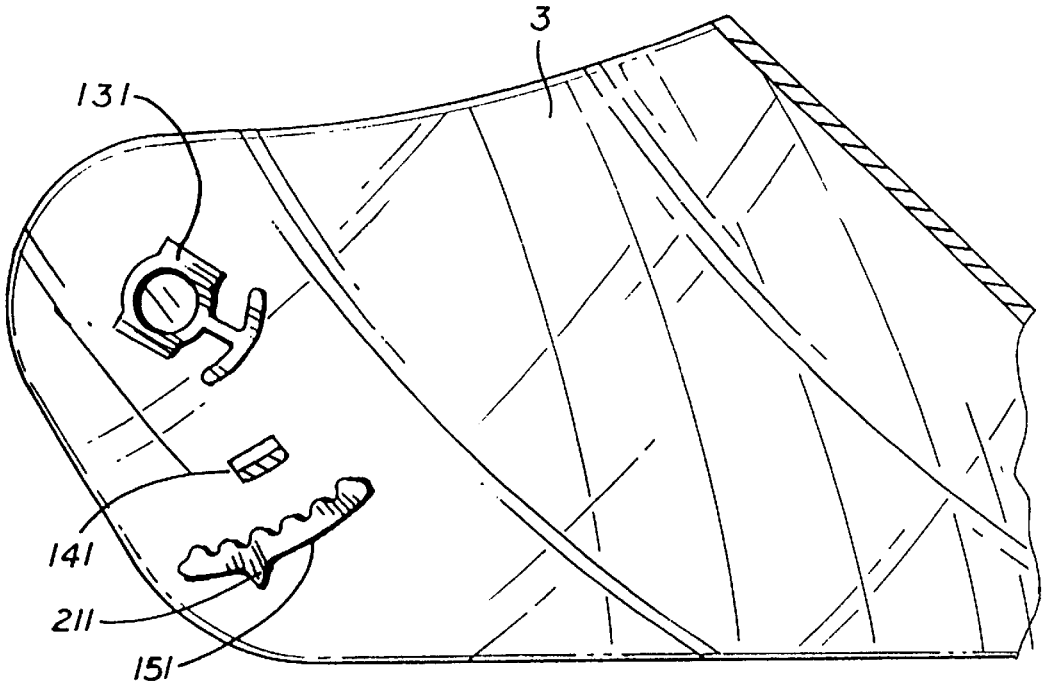
FIG. 14 is a sectional view showing the shield of embodiment 2 of the present invention.

Referring to FIG. 14, a connection member 131 to be accommodated into rotation member 501 is formed at both inner side surfaces of shield 3 which are to be fixed by fixation mechanism 401. Below connection member 131, a protruded guide 141, and a rack-shaped control member 151 which controls the degree of up and down movement of shield by first and second resilient plates 601 and 701, and a minimum opening control protrusion 211 are formed.

A locker 161 which is installed to be rotatable along the outer periphery of guide 801 and has a long handle 171 that is provided in conjunction with rotation member 501 of fixation mechanism 401. Locker 161 has indentations 181 and 182 in order to control a rotation in such a manner that indentations 181 and 182 are caught by indentations 602 and 603 of first resilient plate 601. Locker 161 has at a front surface thereof a protrusion 162 corresponding to plate 112.

Figure 15:
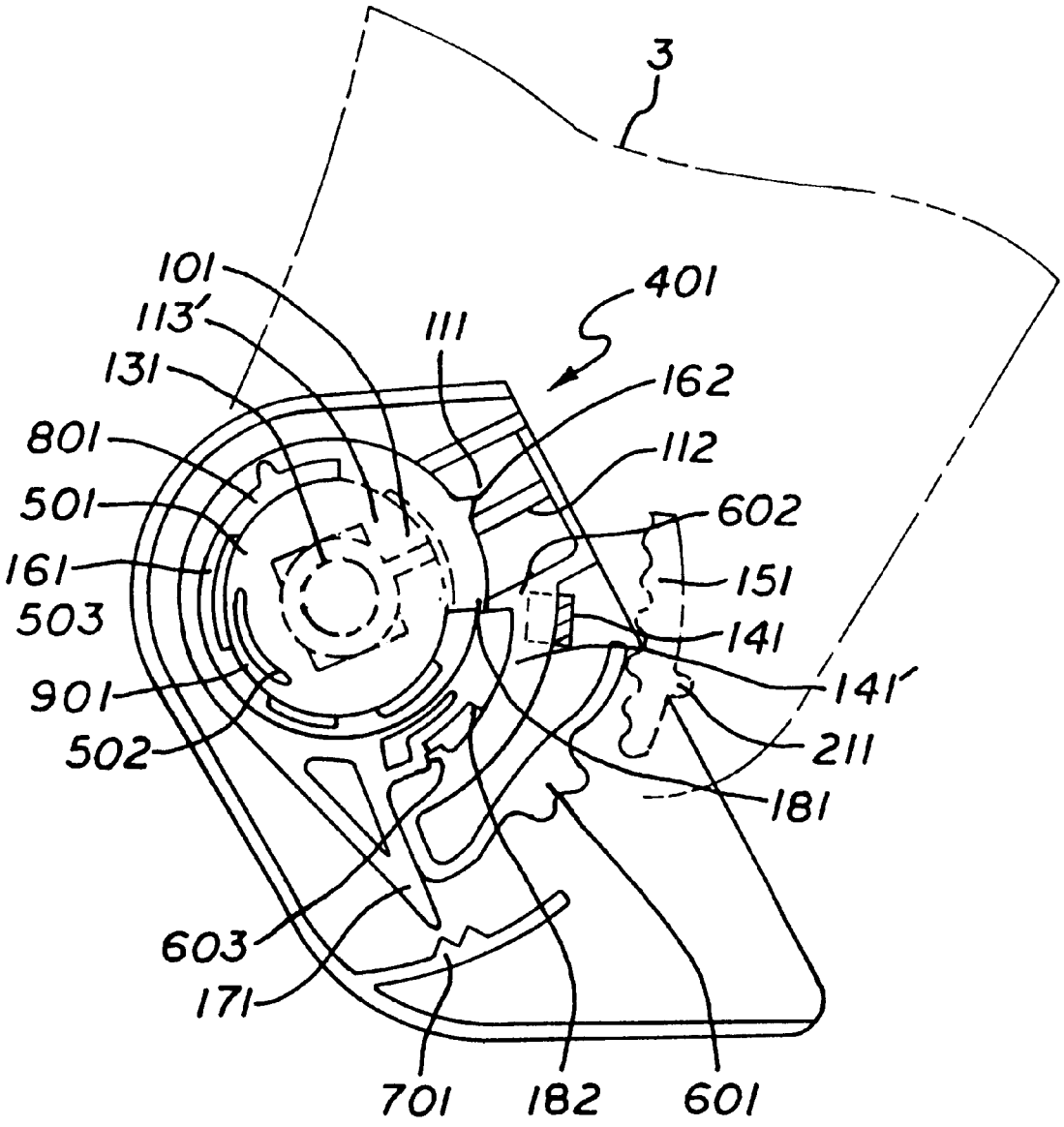
FIG. 15 is a sectional view showing an assembly procedure of the shield of embodiment 2 of the present invention.
Figure 16:
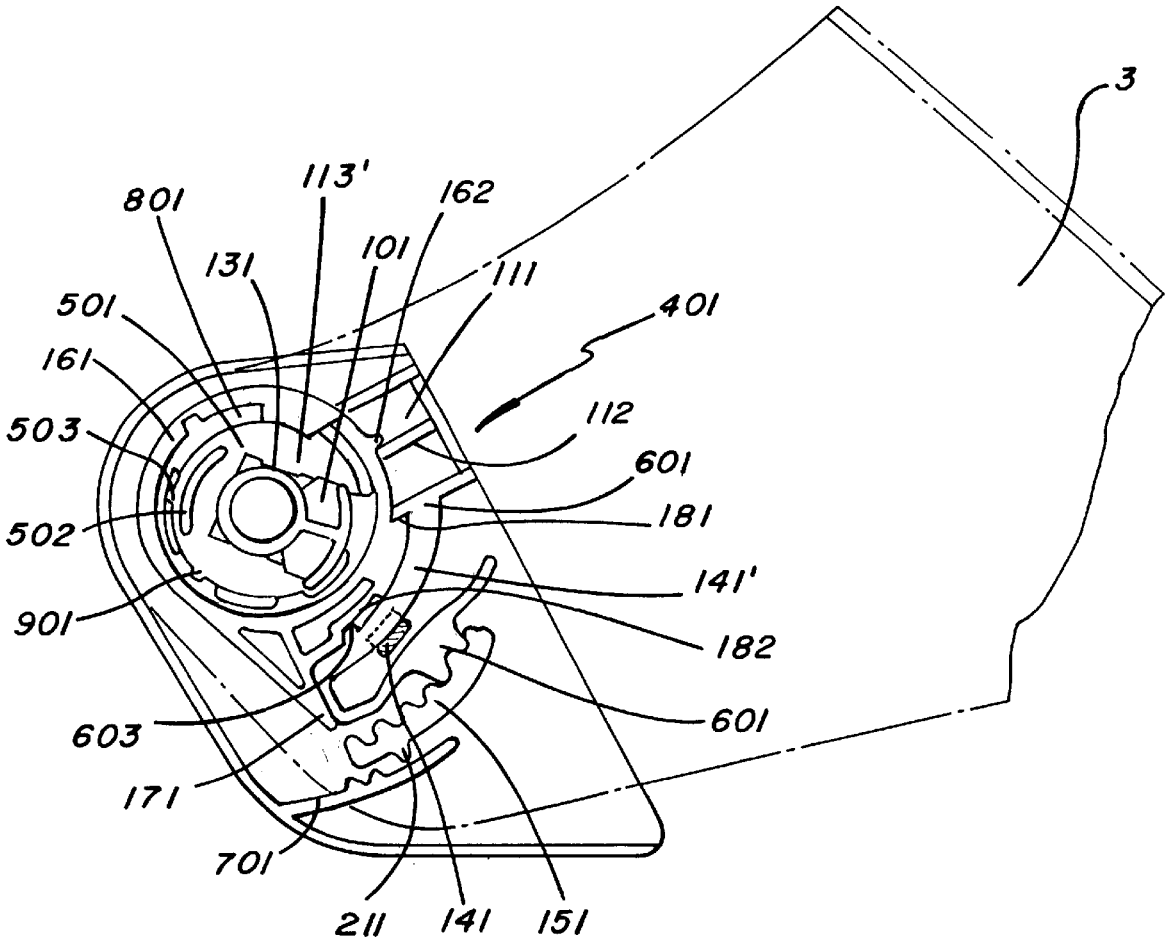
FIG. 16 is a sectional view showing the state where the shield of embodiment 2 is assembled according to the present invention.
Figure 17:
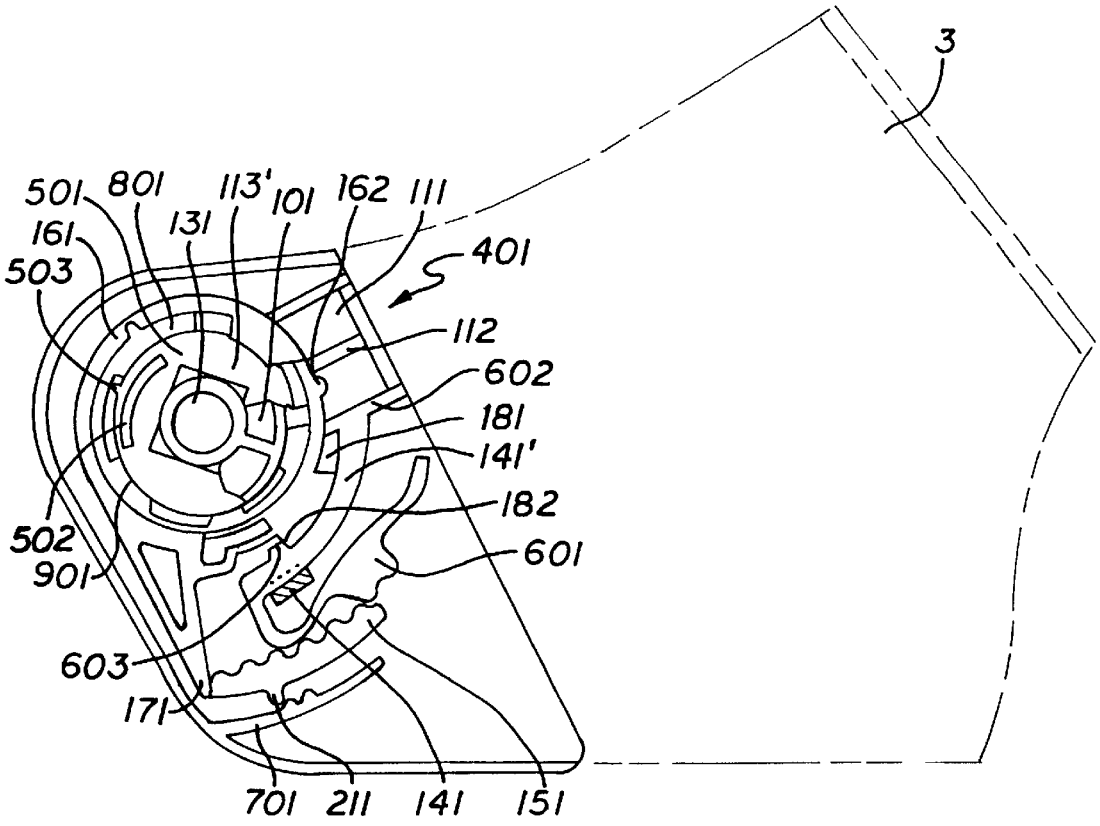
FIG. 17 is a sectional view showing an operation state of the locking mechanism of embodiment 2 of the present invention.

FIGS. 15 through 17 generally illustrate the operation of the mounting mechanism of this embodiment. As in the first embodiment described above, shield 3 is assembled to front opening 2 of helmet body 1 in such a manner that rotation member 5 of fixation mechanism 4 which is installed at both side surfaces of helmet body 1 corresponds to aperture 10 and insertion guiding portion 11, and at such a state, connection member 13 which is formed at the both inner surfaces of shield 3 is inserted to rotation member 5.

Subsequently, a shield axis rotation portion 113 is coupled by a fixation protrusion 113' of rotation member 5. At the same time, rack-shaped control member 15 of shield 3 is combined, so as to control the degree of the rotation of shield 3, with first and second resilient plates 6 and 7 which are provided underneath rotation member 5. Protruded guide 14 of shield 3 is inserted into a guide 14' formed at fixation mechanism 4, thereby coupling shield 3 with fixation mechanism 4.

When shield 3 is so-coupled, rotation member 5 is prevented from being escaped by guide 8 and protrusion 9, completing the assembly of shield 3.

When shield 3 is thus-assembled and moves up and down for opening and closure, locker 16 having handle 17 and which is installed to be rotatable along the outer periphery of guide 8, and spring 19 which is prepared between indentation 18 of locker 16 and insertion guide portion 11 so as to supply a resilience to locker 16, may prevent connection member 13 of shield 3 from being escaped from rotation member 5 in such a way that locking protrusion 20 partially blocks aperture 10 by a power of spring 19 when connection member 13 is inserted to rotation member 5. When connection member 13 is detached from rotation member 5 protrusion 12 is formed and handle 17 is turned toward first resilient plate 6 so as to put handle 17 of locker 16 to release position. Then, locking protrusion 20 rotates and thus opens aperture 10, to thereby draw connection member 13 toward insertion guide portion 11.

It should be noted that the handle 171 in the second embodiment is longer than the handle 17 in the first embodiment. Referring to FIGS. 16 and 17, as the shield is rotated downwardly the member 151 pushes the handle 171 backwardly from an unlocked position (FIG. 16) to a locked position (FIG. 17). The shield is then automatically locked into place as the shield closes.

When the rider rides bicycle or motorcycle on cold days with the shield completely shut, the shield may fog due to condensation of moisture in the breath of the rider. The rider may only need to minimally open the shield to increase helmet ventilation or to defog the interior surface of the shield. For this, a minimum opening control protrusion 21, which may also be called a tooth, and second resilient plate 7 having a detent that is adapted to receive the tooth 21 are provided underneath control member 15. The minimum opening control protrusion or tooth 21 engages in a detent in the resilient plate 7 to hold the shield in a stable minimal-open position. Thus, the rider may open the shield a small amount to create a small opening for ventilation, by minimally moving the shield upwardly from the fully closed position. The present invention extends to a face shield mounting system having this minimimal-open position.

When shield 3 is coupled to fixation mechanism 4 of the helmet body 1, when shield 3 moves up in order to open front opening 2, connection member 13 of shield 3 rotates up and down with rotation member 5 of fixation mechanism 4 so as to be opened and closed. Control member 15 of shield 3 engages with first resilient plate 6 to provide click-stop open positions, such that the shield may be opened to any of a number of different position. Thus, the degree of the rotation of shield 3 is controlled, to thereby ensure stable opening and closure of the shield.

As in the first embodiment, the second embodiment has at both side surfaces of helmet body 1 a rotation member 501 which has at the outer periphery thereof protrusion 503 which operates resiliently by a resilient portion 502, and a fixation mechanism 401 having a first resilient plate 601 with indentations 602 and 603 and a second resilient plate 701 which is provided under first resilient plate 601 are installed. A guide 801 and a protrusion 901 for guiding the rotation of rotation member 501 are formed.

An insertion-guiding portion 111 corresponding to an aperture 101 is formed in a front portion of aperture 101, and a plate 112 is formed at the middle portion of insertion guiding portion 111.

A connection member 131 to be a accommodated into rotation member 501 is formed at both inner side surfaces of shield 3 which are to be fixed by fixation mechanism 401. Below connection member 131, a protruded guide 141, and a rack-shaped control member 151 which controls the degree of up and down movement of shield by first and second resilient plates 601 and 701, and a minimum opening control protrusion 211 are formed.

Subsequently, a shield axis rotation portion 113 is coupled by a fixation protrusion 113' of rotation member 501. At the same time, rack-shaped control member 151 of shield 3 is combined, so as to control the degree of the rotation of shield 3, with first and second resilient plates 601 and 701 which are provided underneath rotation member 501. Protruded guide 141 of shield 3 is inserted into a guide 141' formed at fixation mechanism 401, thereby coupling shield 3 with fixation mechanism 401.

When shield 3 is so-coupled, rotation member 501 is prevented from being escaped by guide 801 and protrusion 901, completing the assembly of shield 3.

When shield 3 is thus-assembled and moves up and down for opening and closure, locker 161 having a long handle 171 and which is installed to be rotatable along the outer periphery of guide 801, is provided to prevent shield 3 from being escaped from fixation mechanism 401. In detail, when shield 3 is lowered down on the connection member of fixation mechanism, the lower portion of control member 15 rotates handle 171 of locker 161, Then, indentations 181 and 182 of locker 161 and an indentation 183 of which rotation is controlled by plate 112 of insertion guide portion 111 are inserted into rotation member 501 so as to partially block aperture 101, to thereby prevent connection member 131 from being escaped from rotation member 501. When connection member 131 is detached from rotation member 501, protrusion 162 is formed and handle 171 is turned toward first resilient plate 6 so as to put handle 171 of locker 161 to release position. Then, connection member 131 rotates and corresponds to aperture 101, to thereby draw connection member 131 toward insertion guide portion 111.

As described above, the present invention addresses to an assembly of a shield to a front opening of a helmet body, in that a rotation member of a fixation member and a connection member of a shield allow a simplified assembly of the shield. In addition, a firm assembly of the shield can be obtained, together with a smooth opening and closing of the shield. Further, the shield can be easily replaced when damaged, and the rider can defog the interior surface of the shield or increase helmet ventilation by minimally opening the shield in cold days.

An assembly of shield to a helmet body can be simplified, and as described in embodiment 2, the locker may have a different structure so as to enhance attachment and detachment of the shield, achieving a rigid assembly of the shield.

It should be understood that although two embodiments of the present invention have been described in detail, the invention itself is not limited to these two specific embodiments. The specific design may be varied from what is described herein while still incorporating the invention. For example, the face shield may be a heated shield of the type described in U.S. Pat. No. 5,694,650, issued on Dec. 9, 1997, which is incorporated by reference herein. The face shield may also be tinted, have a reflective coating, or be any other type of shield, so long as it includes components such as those illustrated in FIG. 8 that interact with the mounting mechanism that is located on the helmet.

Consequently, the scope of the invention is defined in the claims and is not limited to the specific embodiments illustrated here.

What claimed is:

1. A system for removably securing a face shield to a helmet, the system comprising:

a base plate mounted on said helmet, said base plate having a ratchet teeth-engaging tooth and a secondary tooth engagement member;

a locking ring mounted on the base plate, said locking ring having a locking handle and a locking protrusion;

a shield retention member having a shield retention slot and at least one shield retention tab, said shield retention member being rotatably mounted on said helmet;

a shield having a winged circular protrusion and an armed engagement member extending from said circular protrusion, and a ratchet teeth member having ratchet teeth;

wherein said shield is mounted onto said helmet such that said winged circular protrusion is inserted in said shield retention slot and is retained in said shield retention slot by said shield retention tab, and said ratchet teeth are engaged with said ratchet teeth engaging indentation; and said system has a locked configuration in which said locking handle has been rotated into a locked position and in which said locking protrusion is engaged with said armed engagement member of said shield, and an unlocked configuration in which said locking handle has been rotated into an unlocked position and in which said locking protrusion is disengaged from said armed engagement member.

2. A face shield securing system as defined in claim 1 further comprising a bias spring engaged with said locking handle.

3. A face shield securing system as defined in claim 1 wherein said ratchet teeth and winged circular protrusion are integrally molded with said shield.

4. A face shield securing system as defined in claim 1, wherein the shield retention slot is defined by resilient walls.

5. A face shield securing system as defined in claim 1, wherein said face shield has a handle protrusion, said handle protrusion engaging said locking handle, said protrusion moving said locking handle as said shield is raised and lowered on said helmet.

6. A face shield securing system as defined in claim 5, wherein said handle protrusion on said shield comprises said ratchet teeth member.

7. A system for removably securing a face shield to a helmet, the system comprising:

a shield retention unit mounted on said helmet, said unit having at least one tooth extending therefrom, a locking ring having a locking handle and a locking protrusion, and a shield retention slot;

a shield having a shield protrusion, an armed engagement member on said shield protrusion and ratchet teeth;

wherein said shield is mounted onto said helmet such that said shield protrusion is inserted in said shield retention slot, and said ratchet teeth are engaged with said at least one tooth;

said mounting system has a locked configuration in which said locking handle has been rotated into a locked position and in which said locking protrusion is engaged with said armed engagement member of said shield, and an unlocked configuration in which said locking handle has been rotated into an unlocked position and in which said locking protrusion is disengaged from said armed engagement member; and the shield retention slot is defined by resilient walls, said slot comprising at least one retention protrusion.

8. A face shield securing system as defined in claim 7 further comprising a bias spring engaged with said locking handle.

9. A face shield securing system as defined in claim 7 wherein said ratchet teeth are integrally molded with said shield.

10. A face shield securing system as defined in claim 7, wherein said face shield has a handle protrusion, said handle protrusion engaging said locking handle, said protrusion moving said locking handle as said shield is raised and lowered on said helmet.

11. A face shield securing system as defined in claim 10, wherein said handle protrusion on said shield comprises said ratchet teeth.

12. A system for connecting a face shield to a helmet, the system comprising:

a helmet having a front opening;

a face shield that is adapted to be mounted to the helmet such that the face shield is adapted to be opened and closed about the front opening;

said helmet having a left side surface on one side of the front opening and a right side surface on the other side of the front opening, both side surfaces of said helmet body being provided with a fixation mechanism that includes a rotation member, a first resilient plate, and a second resilient plate;

said second resilient plate being installed under said first resilient plate;

said fixation mechanism having a protrusion and a guide for guiding rotation of said rotation member;

said second resilient plate having at an adjacent portion thereof an aperture;

wherein an insertion guide portion to be corresponded to said aperture is formed in a front portion of said aperture, said first resilient plate has at a rear portion thereof a protrusion, said shield to be coupled with said fixation mechanism has, for assembly with said helmet body, at both inner end surfaces thereof a connection member to be inserted to said rotation member, and a protruded guide, and a rack-shaped control member, wherein said protruded guide and rack-shaped control member control a degree of rotation of said shield by said first and second resilient plates.

13. A system for connecting a face shield to a helmet according to claim 12, wherein said rotation member of said fixation mechanism has a locker which is installed to be rotatable along an outer periphery of said guide and has a handle, and a spring is arranged between an indentation of said locker and said insertion guide portion so that said locker has a resilience.

14. A system for connecting a face shield to a helmet according to claim 12, wherein said control member and said fixation member has a shield minimum opening control protrusion and corresponding said second resilient plate.

15. A shield connector system for connecting a face shield to a helmet, in which said face shield is installed to open and close a front opening of a helmet body as said shield moves up and down, said helmet having a helmet body with two side surfaces, both side surfaces of said helmet body being provided with a fixation mechanism including a rotation member, a first resilient plate having indentations and a second resilient plate which is installed under said first resilient plate, said fixation mechanism having a protrusion and a guide for guiding rotation of said rotation member, said rotation member having at an adjacent portion thereof an aperture, an insertion guide portion to be corresponded to said aperture is formed in a front portion of said aperture, said insertion guide portion having at a middle portion thereof a catching plate, said shield to be coupled with said fixation mechanism having, for assembly with said helmet body, at both inner end surfaces thereof a connection member to be inserted to said rotation member, and a protruded guide, and a rack-shaped control member, said protruded guide and rack-shaped member for controlling a degree of rotation of said shield by said first and second resilient plates, and a minimum opening control protrusion.

16. A shield connector system according to claim 15, wherein said rotation member of said fixation mechanism has a locker which is installed to be rotatable along outer periphery of said guide and has a long handle for an automated locking according to a rotation of said control member, and said locker has at a front portion thereof a protrusion corresponding to said catching plate so as to control a locking or a release position.

* * * * *